United States Patent [19]

Greve et al.

[11] 4,223,551

[45] Sep. 23, 1980

[54] APPARATUS FOR ASCERTAINING THE RESISTANCE OF CIGARETTES OR THE LIKE TO AXIAL FLOW OF GASES THERETHROUGH

[75] Inventors: Heinz Greve, Hamburg; Günter Wahle, Reinbek, both of Fed. Rep. of Germany

[73] Assignee: Hauni-Werke Körber & Co., KG, Hamburg, Fed. Rep. of Germany

[21] Appl. No.: 24,180

[22] Filed: Mar. 26, 1979

[30] Foreign Application Priority Data

Mar. 28, 1978 [DE] Fed. Rep. of Germany ..... 2813315

[51] Int. Cl.[3] ..... G01N 15/08

[52] U.S. Cl. ..... 73/38; 73/45.1

[58] Field of Search ..... 73/38, 41, 45, 45.1, 73/45.2

[56] References Cited

U.S. PATENT DOCUMENTS

| | | | |
|---|---|---|---|
| 3,258,117 | 6/1966 | Domeck, Jr. et al. | 73/38 X |
| 3,270,551 | 9/1966 | Schmalz | 73/45.1 |
| 3,386,281 | 6/1968 | Menge et al. | 73/38 X |
| 3,395,570 | 8/1968 | Kochalski | 73/38 X |
| 3,690,149 | 9/1972 | Pezzi | 73/38 |

*Primary Examiner*—Gerald Goldberg
*Assistant Examiner*—Joseph W. Roskos
*Attorney, Agent, or Firm*—Peter K. Kontler

[57] ABSTRACT

Apparatus which ascertains the resistance of filter rod sections or filter cigarettes to axial flow of a gas through their fillers has a drum-shaped conveyor with a row of flutes at one axial end and a row of expandible and contractable hoses at the other axial end. Each hose registers with a flute and receives an article to be tested from the aligned flute during travel past a station where the hose is connected with a suction generating device and/or the flute is connected with a source of compressed air. The hose is thereupon caused to contract so as to sealingly engage at least the major part of the wrapper of the article therewithin, and the article is tested by conveying a stream of testing fluid through its filler. The hose is thereupon caused or allowed to expand, and the tested article is transferred back into the aligned flute. The characteristics of the fluid stream are monitored, and the results of the monitoring operation are used to effect segregation of unsatisfactory articles from satisfactory articles and/or to adjust the perforating unit which makes holes in the wrappers of articles in order to admit atmospheric air into the column of tobacco smoke.

20 Claims, 5 Drawing Figures

APPARATUS FOR ASCERTAINING THE RESISTANCE OF CIGARETTES OR THE LIKE TO AXIAL FLOW OF GASES THERETHROUGH

BACKGROUND OF THE INVENTION

The present invention relates to testing of plain or filter tipped cigarettes, cheroots, cigars or cigarillos and/or filter rod sections. More particularly, the invention relates to improvements in apparatus for ascertaining the resistance to axial flow of air or another gaseous testing fluid through the fillers of rod-shaped articles which constitute or form part of smokers' products. Still more particularly, the invention relates to improvements in apparatus for ascertaining the rate of axial flow of a gaseous testing fluid through rod-shaped articles while the wrappers of such articles are at least partially sealed against the flow of a testing fluid therethrough.

U.S. Pat. No. 3,258,117 to Domeck et al. discloses an apparatus for automatic testing and classifying of cigarettes according to the porosity of their wrappers. The patented apparatus is intended for use in a laboratory (i.e., not in a production line wherein cigarettes are manufactured, provided with filter mouthpieces and inserted into packets) and comprises a hopper which stores a supply of cigarettes to be tested. A fluted drum withdraws cigarettes from the hopper and delivers successive cigarettes to a stationary receiving device at which a sleeve is applied to one end of the cigarette. The sleeve contains a balloon of deformable material which is caused to expand by reducing the pressure along its external surface. This enables the sleeve to be slipped onto a portion of the cigarette to be tested before the balloon expands and sealingly engages the confined portion of the cigarette. The thus confined cigarette is then tested by resorting to a gaseous fluid medium, and the balloon is thereupon expanded to release the freshly tested cigarette. The tested cigarette is admitted into one of several receptacles, depending on the results of the testing operation. The patent to Domeck et al. mentions that the apparatus can be used for testing of cigarettes or filter rod sections. If the tested articles are filter rod sections, the apparatus is to be modified so as to insure that the entire filter rod section is confined in the balloon. The manner in which such modification is to be performed is not disclosed. It would appear that the balloon must be slipped onto a filter rod section while the latter is confined in a flute. A serious drawback of the patented apparatus is that it is not suited for the testing of cigarettes, filter rod sections and like rod-shaped articles which constitute or form part of smokers' products at the rate at which such articles are produced and/or processed in a modern manufacturing plant. For example, recent types of cigarette makers turn out up to and even in excess of 100 cigarettes per second.

OBJECTS AND SUMMARY OF THE INVENTION

An object of the invention is to provide a novel and improved apparatus which can test the resistance of successive cigarettes or analogous rod-shaped articles to axial flow of a gaseous fluid through their fillers at the rate at which the articles issue from a modern making machine or at which the articles are transported in a production line including one or more makers.

Another object of the invention is to provide an apparatus which can accurately ascertain the resistance which the fillers (tobacco and/or filter material) of cigarettes or like rod-shaped articles offer to axial flow of a gaseous fluid therethrough.

A further object of the invention is to provide a high-speed testing apparatus which can be used for the testing of many types of rod-shaped articles of the tobacco processing industry including plain or filter tipped cigarettes, cigars, cheroots or cigarillos and/or filter rod sections.

An additional object of the invention is to provide a high-speed testing apparatus which can ascertain whether the resistance which the filler of a cigarette or the like offers to axial flow of a gaseous fluid therethrough exceeds or is below a range of acceptable resistances.

Another object of the invention is to provide the apparatus with novel and improved means for confining portions of or the entire wrappers of cigarettes or the like during ascertainment of the rate of axial flow of testing fluid through their fillers.

A further object of the invention is to provide a testing apparatus which can be used in existing production lines for the manufacture of plain or filter cigarettes, filter rod sections or other rod-shaped articles constituting or forming part of smokers' products.

The apparatus of the present invention is utilized to ascertain the resistance of fillers of cigarettes, filter rod sections or analogous rod-shaped articles of the type wherein a filler of tobacco and/or filter material is surrounded by an air-permeable (porous and/or intentionally perforated) tubular wrapper to the axial flow of a gaseous testing fluid. The apparatus comprises a plurality of aligned parallel flutes or analogous receiving means for rod-shaped articles, a confining unit for each receiving means (each confining unit comprises a radially expansible and contractible tubular sealing element which is in axial alignment with the respective receiving means), a rotary drum-shaped conveyor or analogous means for transporting the receiving means and the confining units sideways along an endless path, a rotary drum-shaped conveyor or other suitable means for feeding rod-shaped articles into successive receiving means in a first portion of the endless path, means for transferring articles from successive receiving means into the respective sealing elements in a second portion of the endless path (such transferring means may comprise means for establishing a pressure differential between the ends of articles in the receiving means so that the articles are pneumatically transferred from the receiving means into the aligned sealing elements while the sealing elements are in expanded condition), means for contracting successive sealing elements into sealing engagement with portions of or the entire wrappers of articles therewithin in a third portion of the endless path (such contracting means may include means for raising the pressure around the exterior of sealing elements), means for conveying the testing fluid axially through the fillers of articles in successive contracted sealing elements in a fourth portion of the endless path (such conveying means may include a suction generating device which draws a stream of air axially through the fillers of successive articles which advance along the fourth portion of the endless path), means for expanding successive sealing elements in a fifth portion of the endless path (such expanding means may comprise means for reducing the pressure along the exterior of contracted sealing elements so that the sealing elements are disengaged from the wrappers of articles in the respective confining units), means for transferring articles from successive expanded sealing elements back into the respective receiving means (such transferring means may comprise means for establishing a pressure differential between the ends of articles in expanded condition of the surrounding sealing elements so that the articles are pneumatically conveyed from the sealing elements back into the corresponding receiving means), and a rotary drum-shaped conveyor or other suitable means for accepting articles from successive receiving means in a seventh portion of the endless path. The thus emptied receiving means returns into the first portion of the path to receive fresh rod-shaped articles.

The sealing elements preferably comprise radially outwardly extending flanged end portions, and the apparatus then comprises disks, rings and/or analogous means for sealingly clamping the end portions of sealing elements to the transporting means.

The fluid conveying means preferably comprises conduit means which communicates with one end of the wrapper of an article in the fourth portion of the endless path and an adjustable flow restrictor or other suitable means for regulating the rate of flow of testing fluid through the conduit means.

The transporting means preferably comprises discrete chambers for the sealing elements. The expanding means then preferably comprises means for reducing the pressure in the chambers around the respective sealing elements during transport of such elements along the first, second, fifth, sixth and seventh portions of the path, and the contracting means then preferably comprises means for increasing the pressure in the chambers around the respective sealing elements during transport of such elements along the third and fourth portions of the endless path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
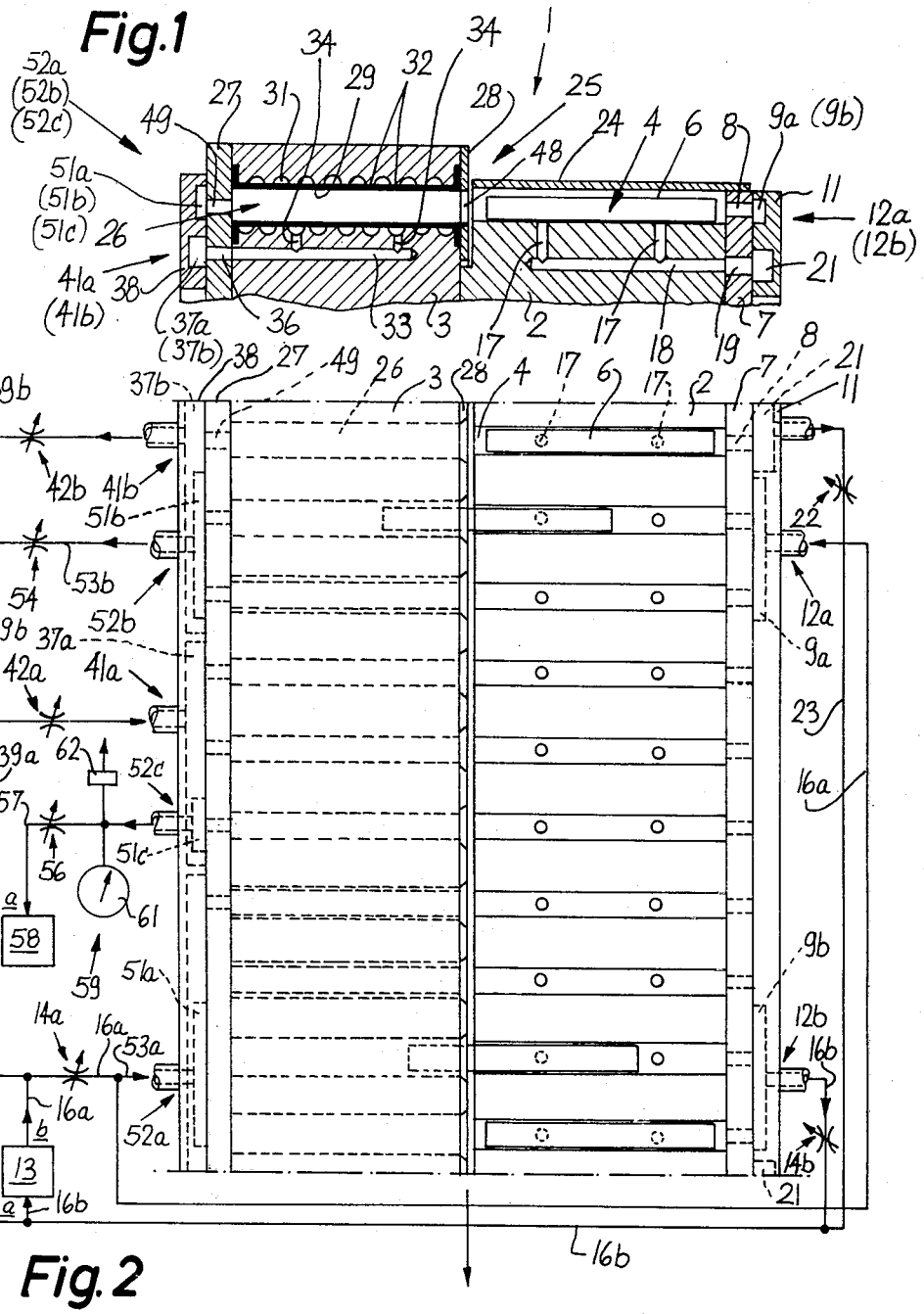
FIG. 1 is a fragmentary axial sectional view of a transporting means in an apparatus which embodies one form of the invention.
FIG. 2 is a developed view of the transporting means and a diagrammatic view of certain other component parts of the apparatus of FIG. 1.

FIGS. 1 and 2 show a transporting means which constitutes a rotary drum-shaped conveyor 1 and includes two coaxial cylindrical sections 2 and 3. The peripheral surface of the section 2 has axially parallel equidistant receiving means in the form of flutes 4. The depth of each flute 4, as considered in the radial direction of the transporting conveyor 1, exceeds the diameters of rod-shaped articles 6 (e.g., filter rod sections of multiple unit length) which are tested in the apparatus including the conveyor 1. The outer ends of the flutes 4 (namely, those ends which are remote from the section 3) are adjacent to a disk 7 which is formed with an annulus of bores or holes 8 each in register with a different flute. The disk 7 forms part of the conveyor 1, i.e., it shares all angular movements of the sections 2, 3 whereby its holes 8 move seriatim into register with arcuate grooves 9*a*, 9*b* of a stationary plate-like valve member 11 which is adjacent to and sealingly engages the outer side of the disk 7. The grooves 9*a*, 9*b* are in communication with a source 13 of pressurized fluid having a suction intake a and an outlet b for pressurized fluid. The adjustable connection between the groove 9*a* and the outlet b is shown at 12*a*, and the adjustable connection between the groove 9*b* and the intake a is shown at 12*b*. The connection 12*a* comprises a conduit 16*a* which contains an adjustable flow restrictor 14*a*, and the connection 12*b* comprises a conduit 16*b* containing an adjustable flow restrictor 14*b*.

The section 2 is formed with pairs of suction ports 17 which communicate with the respective flutes 4 and with axially parallel channels 18. The channels 18 are blind bores which are machined into the outer end face of the section 2 and whose open ends communicate with bores or holes 19 in the disk 7. Groups of successive neighboring holes 19 communicate with an arcuate groove 21 of the stationary valve member 11 in certain angular positions of the conveyor 1. The groove 21 is connected to the suction intake a of the source 13 by a conduit 23 which contains an adjustable flow restrictor 22. The conduit 23 is connected with the intake a by a portion of the conduit 16*b*.

A portion of the peripheral surface of the section 2 (and the corresponding number of flutes 4) is overlapped by an arcuate stationary shroud 24 which is affixed to the frame of the testing apparatus (the shroud is omitted in FIG. 2).

The flutes 4 of the section 2 register with discrete confining units 25 at the periphery of the section 3. Each confining unit 25 comprises a flexible tubular sealing element 29 (hereinafter called hose) which consists of elastomeric material (e.g., rubber) and is installed in an axially parallel bore or chamber 26 adjacent to the periphery of the section 3. The flanged outer end portions of the hoses 29 are clamped to the conveyor section 3 by a disk 27 which forms part of the conveyor 1 and rotates with the section 3. The flanged inner end portions of the hoses 29 (namely, those end portions which are adjacent to the section 2) are clamped to the section 3 by a flat ring 28 which also constitutes a component part of the conveyor 1. When the hoses 29 are not expanded, their inner diameters are smaller than the diameter of an article 6. In order to effect radial expansion of the hoses 29, the section 3 is formed with helical recesses or grooves 31 machined into the surfaces surrounding the chambers 26. The convolutions of each groove 31 alternate with the convolutions of a projection here shown as a rib or web 32 which constitutes a support for the external surface of the respective hose 29 and insures that, when the hose is expanded, its outer surface is subjected to uniformly distributed subatmospheric pressure. Each groove 31 communicates with several suction ports 34 which further communicate with a channel 33. The channels 33 are blind bores which are machined into the section 3 inwardly of the respective chambers 26 and whose open ends communicate with discrete bores or holes 36 of the disk 27. In certain angular positions of the conveyor 1, the bores 36 communicate with the arcuate groove 37*b* of a stationary plate-like valve member 38 which sealingly engages the outer side of the disk 27. The connection 41*b* between the groove 37*b* and the intake a of the source 13 comprises a conduit 39*b* which contains an adjustable flow restrictor 42*b*. The valve member 38 has a second arcuate groove 37*a* which is in line with the bores 36 and communicates with the outlet b of the source 13 by way of a connection 41*a* including a conduit 39*a* which contains an adjustable flow restrictor 42*a*.

The clamping ring 28 has bores or holes 48 which connect the inner ends of the flutes 4 with the adjacent ends of the aligned chambers 26. The clamping disk 27 has bores or holes 49 which communicate with the outer end portions of the respective chambers 26. The holes 49 communicate seriatim with grooves 51*a*, 51*b*, 51*c* of the valve member 38. The connection 52*a* between the groove 51*a* and the conduit 16*a* downstream of the flow restrictor 14*a* comprises a conduit 53*a*. The connection 52*b* between the groove 51*b* and the intake a of the source 13 comprises a conduit 53*b* which branches off the conduit 39*b* and contains an adjustable flow restrictor 54. The connection 52*c* between the groove 51*c* and the suction intake a of a source 58 of pressurized testing fluid comprises a conduit 57 containing an adjustable flow restrictor 56. The groove 51*c* of the valve member 38 draws testing fluid through the articles 6 in the adjacent hoses 29. The means 59 for monitoring a characteristic of testing fluid in the conduit 57 upstream of the flow restrictor 56 and downstream of the groove 51*c* comprises an electropneumatic signal generating transducer 62 and a high-inertia pressure gauge 61. The gauge 61 may be of the type known as encapsulated spring manometer. A transducer which can be used in the monitoring means 59 is disclosed in commonly owned U.S. Pat. No. 3,412,856 to Esenwein.

The operation:

A conveyor FC (FIG. 2*a*) feeds filter rod sections 6 into successive flutes 4 of the conveyor section 2, and such sections 6 are retained in the respective flutes as long as the flutes communicate with the arcuate groove 21 of the valve member 11 by way of the associated groups of suction ports 17, channels 18 and holes 19. At such time, i.e., while a flute 4 which contains a filter rod section 6 travels past the groove 21, the corresponding groove 31 is also connected to the suction intake a of the source 13 by way of associated ports 34, channel 33, hole 36, groove 37*b* of the valve member 38 and conduit 39*b*. When a flute 4 which contains a filter rod section 6 begins to communicate with the groove 9*a* (which is connected with the outlet b of the source 13 by the conduit 16*a*), the corresponding chamber 26 (i.e., the interior of the expanded hose 29 therein) communicates with the groove 51*b* of the valve member 38 and hence with the suction intake a of the source 13 by way of the associated hole 49 and conduit 53*b*. The air stream which flows through such flute 4 and through the interior of the associated hose 29 advances the filter rod section 6 axially into the corresponding confining unit 25 wherein the section 6 comes to rest when its left-hand end face abuts against the clamping disk 27 which constitutes a stop for the filter rod sections. When the flute 4 (which is now empty) advances beyond the groove 9*a*, and the corresponding hose 29 (which is expanded and spacedly surrounds a filter rod section 6) advances beyond the groove 51*b*, the corresponding hole 36 ceases to communicate with the groove 37*b* so that the groove 31 is sealed from the intake a of the source 13. Therefore, the hose 29 contracts radially and sealingly engages and closely surrounds the tubular wrapper of the filter rod section 6 in its interior. In addition, the sealing action of the hose 29 is promoted due to the fact that the groove 31 receives compressed air because the hole 36 communicates with the outlet b of the source 13 via groove 37*a* of the valve member 38 and conduit 39*a*. The hole 49 which registers with the contracted hose 29 thereupon begins to communicate with the groove 51*c* of the valve member 38 which draws testing fluid (normally air) axially through the sealingly engaged filter rod section 6, such testing fluid flowing to the intake a of the source 58 by way of the conduit 57. The subatmospheric pressure upstream of the flow restrictor 56 is registered by the gauge 61, i.e., the position of the pointer of this gauge is indicative of resistance which the filler of the tested filter rod section 6 offers to axial flow of testing fluid therethrough. Since the filter rod sections 6 in neighboring units 25 are tested in rapid succession and the inertia of the gauge 61 is relatively high, the position of the pointer of this gauge is indicative of average resistance which the fillers of a series of successively tested sections 6 offer to axial flow of testing fluid therethrough. Moveover, suction in the conduit 57 upstream of the flow restrictor 56 causes the transducer 62 to transmit appropriate electric signals at the same frequency at which the filter rod sections 6 advance past the relatively short groove 51*c* (in the embodiment of FIGS. 1 and 2, this groove communicates with one hole 49 at a time). Electric signals which are generated and transmitted by the transducer 62 during or as a result of testing of sections 6 whose resistance to axial flow of testing fluid is excessive or too low can be utilized to segregate such filter rod sections from other (satisfactory) filter rod sections. This will be described with reference to FIG. 4.

Alternatively, or in addition to segregation of defective sections 6, signals which are generated by the transducer 62 and denote unsatisfactory rod-shaped articles can be transmitted to the machine which makes or processes such articles. If the articles are filter rod sections, "defect" signals can be utilized to regulate the quantity of filter tow per unit length of the filter rod which is formed and severed in a filter rod making machine. A suitable machine is disclosed in commonly owned U.S. Pat. No. 3,971,695 granted July 27, 1976 to Hans-Jürgen Block.

Upon completion of testing of a section 6, the corresponding hole 36 of the clamping disk or stop 27 advances beyond the groove 37*a* and returns into register with the groove 37*b*, i.e., the groove 31 is connected with the suction intake a of the source 13 and the hose 29 is caused to expand radially so that its external surface contacts the rib 32 in the respective chamber 26. The tested section 6 is free to move axially and returns into the corresponding flute 4 when the hole 49 begins to communicate with the groove 51*a* and the hole 8 communicates with the groove 9*b*. The air stream then enters at 49 and leaves at 8. The tested section 6 is held in the flute 4 by suction in the corresponding ports 17 on its way toward the station $T_2$ (FIG. 2*a*) where tested filter rod sections are transferred from the conveyor 1 onto another conveyor AC or into the magazine of a filter tipping machine or the like.

The mode of operation of the apparatus which embodies the transporting conveyor 1 of FIGS. 1 and 2 will be even more readily understood by referring to FIG. *2a* which shows that the conveyor 1 transports the flutes 4 and the confining units 25 sideways along an endless path. The fluted rotary drum-shaped feeding conveyor FC delivers filter rod sections 6 into successive flutes 4 in a first portion of the endless path, namely, at a transfer station $T_1$ which is located immediately ahead of the shroud 24. At such time, the filter rod sections 6 are attracted to the surfaces bounding the innermost portions of the respective flutes 4 because the corresponding suction ports 17 are connected with the intake a of the source 13 by way of the groove 21 in the valve member 11 (see the upper portion of FIG. 2). The flute 4 which contains a freshly admitted filter rod section 6 thereupon advances into a second portion of the endless path, namely, into register with the groove 9*a* whereby the apparatus establishes a pressure differential between the two end faces of the filter rod section 6 and the latter is thereby caused to enter the expanded sealing element or hose 29 of the aligned confining unit 25. The hose 29 is expanded because the respective ports 34 communicate with the intake a of the source 13 by way of the groove 51*b*. The expanded sealing element 29 which contains a filter rod section 6 is thereupon advanced into a third portion of the endless path and is caused to contract radially because the ports 34 receive compressed air from the outlet b of the source 13 by way of the groove 37*a*. The contracted sealing element 29, which sealingly engages the wrapper of the filter rod section 6 therewithin, then enters a fourth portion of the endless path, and a stream of testing fluid drawn by the intake a of the source 58 is caused to flow axially through its filler because the respective hole 49 moves past and communicates with the groove 51*c*. The still contracted sealing element 29 thereupon advances into a fifth portion of the endless path where the respective ports 34 communicate with the intake a of the source 13 because the corresponding hole 36 moves past the groove 37*b*. When the expanded sealing element 29 reaches a sixth portion of the endless path, in which the respective hole 49 communicates with the outlet b of the source 13 via groove 51*a* and the respective bore 8 communicates with the intake a of the source 13 via groove 9*b*, the tested filter rod section 6 is transferred back into the aligned flute 4 owing to establishment of a pressure differential at the opposite end faces of such filter rod section. The filter rod section 6 is accepted by the fluted rotary drum-shaped conveyor AC when it reaches a seventh portion of the endless path, namely, when it reaches the transfer station $T_2$ between the conveyors 1 and AC. The corresponding sealing element 29 remains in expanded condition because the groove 37*b* extends beyond the groove 51*a*, as considered in the circumferential direction of the conveyor 1. In fact, and as shown in FIG. 2, the groove 37*b* extends to and beyond the groove 51*b* so that the sealing element 29 remains in expanded condition during travel past the transfer station $T_1$ (where the corresponding flute 4 receives a fresh filter rod section 6 from the feeding conveyor FC) and also during travel past the second portion of the endless path where the freshly inserted filter rod section 6 is introduced into the respective confining unit 25. The aforementioned travel of such sealing element 29 past the fourth, fifth, sixth and seventh portions of the endless path is then repeated with the result that the fresh filter rod section 6 is sealingly engaged by the element 29, tested during travel past the groove 51*c*, disengaged from the element 29 during travel past the groove 37*c*, transferred back into the corresponding flute 4 during transport past the groove 51*a* and transferred into the oncoming flute of the accepting conveyor AC at the station $T_2$.

The shroud 24 can extend along the second to sixth portions of the endless path for the flutes 4. However, it suffices to provide two relatively small shrouds 24 (see FIG. 2a) one of which is adjacent to flutes 4 during transfer of sections 6 from such flutes into the aligned sealing elements 29 and the other of which is adjacent to the flutes 4 which are transported along the sixth portion of the endless path, i.e., during transfer of tested sections 6 from their sealing elements 29 back into the respective flutes.

The wrappers of filter rod sections 6 may consist of porous paper or they may form integral parts of the respective fillers. For example, filter rod sections wherein the wrappers are integral with the fillers can be formed by heat treatment of the exterior of a rod consisting of filamentary or other filter material. The projections or ribs 32 provide supports for the adjacent portions of the relatively long hoses 29 when such hoses are expanded in response to reduction of pressure in the respective grooves or recesses 31. Each such groove can be said to consist of a plurality of recesses all of which communicates with the respective chamber 26 and from each of which air is withdrawn when the ports 34 are connected with the suction intake a of the source 13. This source can be said to constitute a combined suction generating device (intake a) and a source of pressurized fluid (outlet b). It is clear, however, that the apparatus of FIGS. 1–2*a* can be equipped with a discrete source of pressurized fluid which is connected with the conduit 16*a*, and with a discrete suction generating device which is connected with the conduit 16*b*. Connection of the entire groove 31 in each chamber 26 to the intake a of the source 13 when the respective chamber 26 travels past the groove 37*b* of the valve member 38 is desirable to insure uniform expansion of the entire sealing element 29 all the way between its flanged end portions.

The feature that the holes or bores 49 can move into register with the grooves 51*a*, 51*b* and 51*c* of the valve member 38 contributes to simplicity of the transporting conveyor 1 because the holes 49 are in communication with the groove 51*c* during testing of filter rod sections 6, with the groove 51*b* during transfer of sections 6 from the flutes 4 into the respective sealing elements 29; and with the groove 51*a* during transfer of tested sections 6 from the sealing elements 29 back into the respective flutes 4.

Figure 2A:
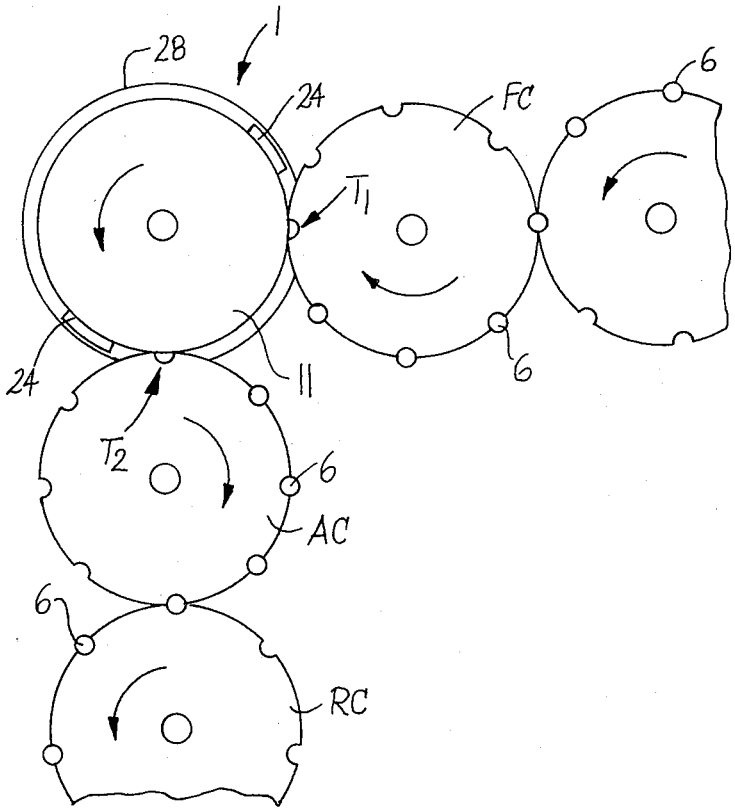
FIG. 2*a* is an end elevational view of the apparatus which embodies the structure of FIGS. 1 and 2.

It will be readily appreciated that the apparatus of FIGS. 1 to 2*a* can be modified by transferring the sections 6 into the aligned sealing elements 29 exclusively by suction. The groove 9*a* is then omitted and the intake a of the source 13 draws air from successive sealing elements 29 during travel of such elements past the groove 51*b*. Air which is drawn by the intake a of the source 13 is admitted into the sealing elements 29 through the gaps between the respective flutes 4 and the adjacent shroud 24. Analogously, the sections 6 can be transferred from the flutes 4 into the sealing elements 29 solely by compressed air which is admitted by the groove 9*a* and escapes through the clearances between the respective flutes 4 and the adjacent shroud 24. The same holds true for the transfer of sections 6 from the sealing elements 29 into the respective flutes 4 during travel along that (sixth) portion of the endless path for the flutes which extends between the grooves 9*b* and 51*a*.

Figure 3:
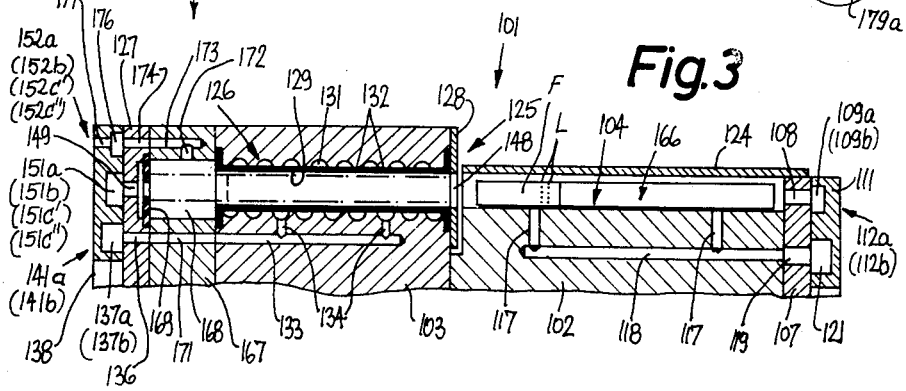
FIG. 3 is a fragmentary axial sectional view of a modified transporting means.

FIG. 3 shows the transporting conveyor 101 of a modified apparatus which renders it possible to ascertain the influence of the so-called climatic zone upon the resistance which the fillers of articles 166 offer to axial flow of a gaseous fluid therethrough. All such parts which are identical with or clearly analogous to corresponding parts of the apparatus of FIGS. 1–2 are denoted by similar reference characters plus 100.

The filter cigarette 166 in the flute 104 is provided with a climatic zone including two rows of holes or perforations L made in the wrapper of the filter mouthpiece F. The porosity of the wrapper of the filter mouthpiece F is relatively low, i.e., one need not anticipate inaccurate measurements by disregarding the porosity (if any) of the material of such wrapper.

A disk 167 is inserted between the cylindrical section 103 and the disk 127. The thickness of the disk 167, as considered in the axial direction of the transporting conveyor 101, at most equals but is preferably somewhat less than the length of the filter mouthpiece F of the filter cigarette 166. The disk 167 is formed with bores 168 which constitute auxiliary chambers and register with the chambers 126. The holes 149 admit testing fluid into the auxiliary chambers 168; the right-hand ends of these holes are surrounded by elastic sealing washers 169 which sealingly engage the marginal portion of the exposed end face of the filter mouthpiece F to thereby seal the chambers 168 from the holes 149. Thus, the holes 149 can admit or draw testing fluid into or from the fillers of the filter mouthpieces F but such fluid cannot enter the respective auxiliary chambers 168. Each washer 169 can be said to constitute a flexible membrane having a centrally located aperture for admission of testing fluid into or for evacuation of testing fluid from the respective end of the filter mouthpiece F. The disk 167 is further formed with holes or bores 171 which establish communication between the holes 136 and the registering channels 133. This disk performs the clamping function of the disk 27, i.e., it maintains the flanged left-hand end portion of the adjacent sealing element 129 in sealing engagement with the section 103.

The valve member 138 has an arcuate groove 176 which communicates, in certain angular positions of the conveyor 101, with the auxiliary chambers 168 via bores 172, 173 in the disk 167 and a bore or hole 174 in the disk 127. The groove 176 communicate with the atmosphere by way of a venting hole 177 in the valve member 138.

Figure 4:
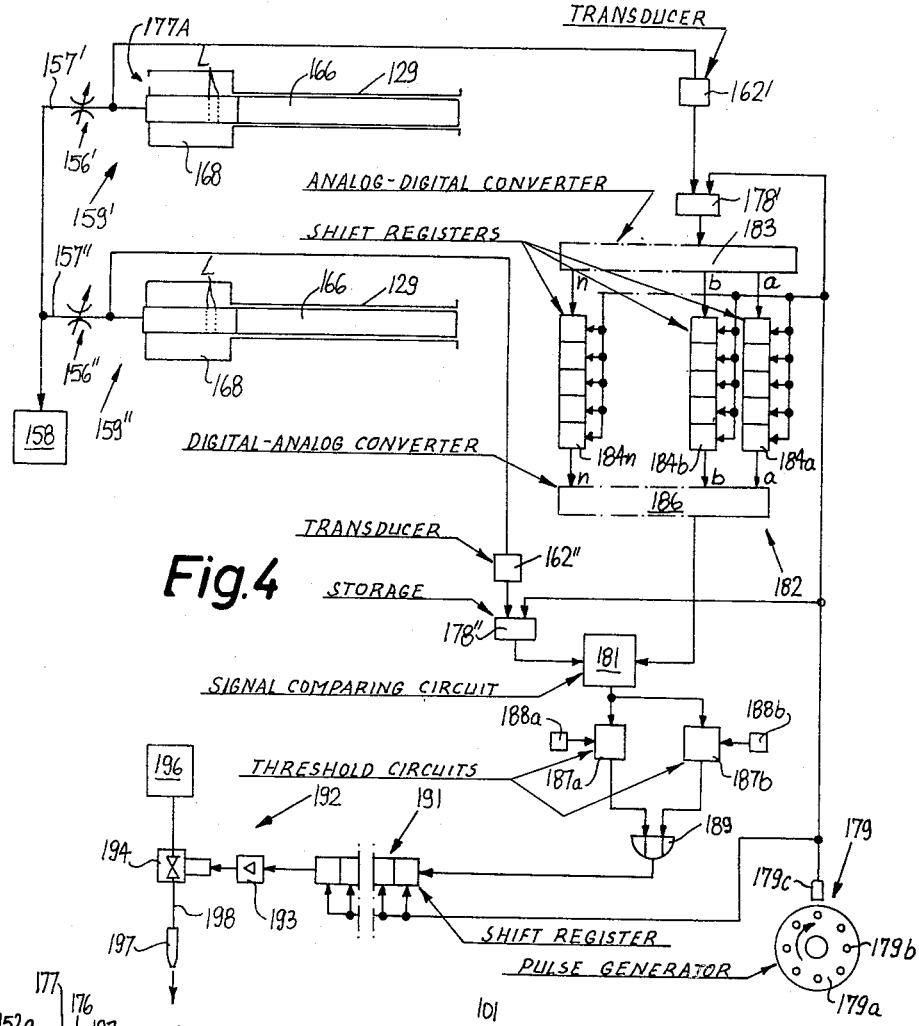
FIG. 4 is a diagrammatic view of the apparatus which embodies the transporting means of FIG. 3.

FIG. 4 shows that the conveyor 101 transports successive filter cigarettes 166 past two testing stations 159' and 159''. The station 159' is adjacent to the fourth portion and the station 159'' is adjacent to a next-following (further) portion of the endless path for the flutes 104 and confining units 125. The apparatus of FIGS. 3 and 4 comprises two connections 152*c'* and 152*c''* including two grooves 151*c'*, 151*c''* in the valve member 138.

FIG. 4 further shows that the auxiliary chamber 168 which reaches the first testing station 159' is maintained at atmospheric pressure, i.e., it communicates with the atmosphere via bores 172, 173, 174, groove 176 of the valve member 138 and venting hole 177 (indicated symbolically at 177A).

The groove 151*c'* of the valve member 138 is connected with a conduit 157' which contains an adjustable flow restrictor 156' located downstream of a testing unit including a signal generating electropneumatic transducer 162' (e.g., of the type disclosed in the aforementioned U.S. Pat. No. 3,412,856 to Esenwein). The groove 151*c''* of the valve member 138 is connected with a second conduit 157'' which contains an adjustable flow restrictor 156'' located downstream of a signal generating electropneumatic transducer 162''. The conduit 157'' branches from the conduit 157' which is connected with the suction intake of a suction generating device 158 corresponding to the source 58 of FIG. 2.

The outputs of the transducers 162' and 162'' are respectively connected with the corresponding (first) inputs of adjustable signal storing circuits 178', 178''. The second inputs of the circuits 178', 178'' are connected with the output of a pulse generator 179. The latter includes a disk 179*a* provided with an annulus of magnets 179*b* which travel past a proximity detector 179*c* whereby the latter transmits signals to the second inputs of the circuits 178', 178''. The distribution of magnets 179*b* is the same as that of the chambers 168 in the disk 167, and the disk 179*a* is driven in synchronism with the conveyor 101. The circuits 178', 178'' cooperate with the pulse generator 179 to insure that signals which are generated by the transducers 162', 162'' are transmitted at appropriate times, namely, when the corresponding filter cigarettes 166 respectively travel past the grooves 151*c'*, 151*c''* of the valve member 138.

The outputs of the circuits 178', 178'' are connected with a signal comparing circuit 181 which is a differentiating circuit. The latter must receive, simultaneously, signals which are generated by the transducers 162', 162'' during testing of one and the same filter cigarette 166. Therefore, and since the testing station 159' is located ahead of the testing station 159'', as considered in the direction of rotation of the transporting conveyor 101, a time-delay unit 182 is installed between the output of the circuit 178' and the corresponding input of the differentiating circuit 181. The time-delay unit 182 comprises means for transporting analog and digital test signals in imitation of transport of a filter cigarette 166 from the testing station 159' to the testing station 159''. More specifically, the unit 182 includes an analog-digital converter circuit 183 with outputs a to n. Each of these outputs is connected with a discrete shift register 184*a* to 184*n*. The pulse generator 179 is connected with the shift registers 184*a*–184*n* so that the signals which are transmitted by the respective outputs a to n of the converter circuit 183 are transported at the speed of transport of filter cigarettes 166 toward the last stages of the shift registers. The last stages of the shift registers 184*a* to 184*n* respectively transmit signals to the corresponding inputs a to n of a digital-analog converter circuit 186 whose output is connected with the right-hand input of the differentiating circuit 181.

The output of the differentiating circuit 181 is connected with threshold circuits 187*a* and 187*b* which receive reference signals from suitable sources 188*a*, 188*b* (e.g., adjustable potentiometers). The threshold circuit 187*a* transmits a signal to the corresponding input of an OR gate 189 when the intensity or another characteristic of the signal from the differentiating circuit 181 is less than the corresponding characteristic of the reference signal from the source 188*a*, and the output of the threshold circuit 187*b* transmits a signal to the respective input of the OR gate 189 when the intensity or another characteristic of the signal from the differentiating circuit 181 exceeds the corresponding characteristic of the reference signal from the source 188*b*. The output of the OR gate 189 is connected with the first stage of a further shift register 191 which constitutes a time-delay device for "defect" signals from the gate 189. Such defect signals are transmitted to an amplifier 193 which energizes the solenoid of a normally closed electromagnetic valve 194 in a conduit 198 which connects a source 196 of compressed fluid (e.g., air) with an ejector nozzle 197. The latter is adjacent to the path of transport of filter cigarettes 166 downstream of the second testing station 159" and causes expulsion of a cigarette which is adjacent to its orifice when the solenoid of the valve 194 is energized. The shift register 191 receives signal transporting pulses from the proximity detector 1879*c* of the pulse generator 179. Thus, a signal which is transported through the stages of the shift register 191 reaches the amplifier 193 when the cigarette 166 whose testing has resulted in the generation of a "defect" signal at the station 159' and/or 159" reaches the orifice of the nozzle 197. The reference character 192 denotes the ejecting device which includes the parts 193, 194, 196, 197 and 198. The "defect" signals denote that the respective cigarettes 166 have unsatisfactory wrappers whose permeability is excessive or too low. The nozzle 197 can be mounted in or adjacent to a transfer conveyor or another conveyor which receives cigarettes 166 (directly or indirectly) from the conveyor 101.

The transducers 162', 162", the circuit 181 and the circuits 187*a*, 187*b* can be said to constitute an evaluating unit which evaluates the characteristics of testing fluids passing through the filler of each cigarette 166 during transport past the stations 159' and 159".

It will be noted that the length of sealing elements 129 is less than the length of a cigarette 166.

The operation of the apparatus of FIGS. 3 and 4 is as follows:

The transfer of filter cigarettes 166 from the receiving means or flutes 104 of the conveyor section 102 into the chambers 126 of the conveyor section 103 and back into the flutes 104 is carried out in the same way as described in connection with FIGS. 1 and 2. When a cigarette 166 in the chamber 126 travels past the first testing station 159', the signal storing circuit 178' receives a signal from the transducer 162', and such signal denotes the resistance which the filler of the cigarette 166 offers to the axial flow of testing fluid therethrough while the auxiliary chamber 168 communicates with the atmosphere, i.e., while such auxiliary chamber is connected with the venting hole 177. The timing of transmission of signals to the circuit 178' is controlled by the pulse generator 179. Thus, signals which are transmitted by the transducer 162' during travel of successive cigarettes 166 past the testing station 159' denote the rate of fluid flow through the filler of the cigarette while the holes or perforations L in the uniting band (wrapper of the filter mouthpiece F) of the respective cigarette communicate with the atmosphere via chamber 168, bores 172, 173, 174, groove 176 and hole 177. The signal from the transducer 162' is transmitted to the converter circuit 183 of the time-delay device 182 and is delayed until the cigarette 166 which has been tested at the station 159' reaches the second testing station 159".

The signal which is generated by the transducer 162" during transport of a filter cigarette 166 (i.e., of the cigarette which was already tested at the station 159') past the testing station 159" denotes the resistance of the filler of the cigarette to the axial flow of testing fluid therethrough, i.e., the holes L are then sealed from the venting hole 177 in the valve plate 138 because the corresponding bore 174 of the disk 167 does not communicate with the groove 176.

The two inputs of the differentiating circuit 181 receive signals from the circuit 178" and converter circuit 186. The circuit 181 transmits a signal which is indicative of the condition of the respective cigarette 166, and such signal is transmitted to the threshold circuits 187*a*, 187*b*. When the intensity of the differentiated signal is too high, the corresponding cigarette 166 is unsatisfactory because the holes L of its wrapper admit excessive quantities of atmospheric air. Inversely, when the intensity of the signal at the output of the circuit 181 is too low, the combined cross-sectional area of holes L is insufficient to allow for admission of requisite quantities of atmospheric air into the filler of the respective cigarette 166. In each instance, the OR gate 189 transmits a signal to the shift register 191 so as to effect expulsion of the corresponding cigarette 166 by the ejecting device 192. As mentioned above, segregation of cigarettes 166 with defective wrappers from satisfactory cigarettes can take place on a conveyor (e.g., the rotary drum AC or RC of FIG. 2*a*) which is installed downstream of the conveyor 101.

The manner of making perforations L in the uniting bands which connect the filter mouthpieces F to the respective plain cigarettes of the rod-shaped articles 166 is known. Reference may be had, for example, to commonly owned copending application Ser. No. 841,108 filed Oct. 11, 1977 by Günter Wahle et al. or to commonly owned copending application Ser. No. 864,441 filed Dec. 27, 1977 by Elke Lüders et al. The perforations L are believed to reduce the presumably deleterious effects of certain ingredients of tobacco smoke, such as nicotine and condensates, by admitting a certain amount of atmospheric air into the column of tobacco smoke flowing into a smoker's mouth.

Apparatus for testing the permeability of so-called conditioning zones (which include the perforations L) of the wrappers of filter cigarettes or like rod-shaped articles which constitute or form part of smokers' products are disclosed, for example, in commonly owned copending applications Ser. Nos. 852,962 and 859,950 of Uwe Heitmann et al. In accordance with such prior proposals, one testing operation involves ascertaining the permeability of the entire wrapper of a filter cigarette including the so-called climatic zone (i.e., the wrapper portion which is formed with holes L or similar perforations), and a preceding or next-following testing operation includes ascertaining the permeability of the climatic zone alone. A comparison of the results of the two testing operations renders it possible to ascertain the rate at which the climatic zone admits air into the column of tobacco smoke. It will be noted that the apparatus of FIGS. 3 and 4 operates in a different way because the permeability of the major portion of the wrapper of a cigarette 166 is not tested at all.

More specifically, the apparatus of FIGS. 3 and 4 ascertains the extent to which the presence of a climatic zone (wrapper portion with holes L) influences the resistance of the filler to the axial flow of a gas (e.g., tobacco smoke) therethrough. This is achieved by the provision of chambers 168 which communicate with the holes L and are in communication with the atmosphere during one of the testing operations (station 159') but are sealed from the atmosphere during the other testing operation (station 159''). The membranes 169 seal the chambers 168 from the open ends of the wrappers for the filter mouthpieces F but permit the fillers of the filter mouthpieces to communicate with the groove 151*c*' or 151*c*'' during travel of the respective confining unit 125 along the respective portion of the endless path which is defined by the transporting conveyor 101.

The signals which are transmitted by the output of the circuit 181 of FIG. 4 can also be used to influence the operation of the unit which forms the holes L, i.e., to alter the combined cross-sectional area of holes L (by changing the size and/or the number of such holes) when the monitored resistance to axial flow is outside of an acceptable range.

An important advantage of the improved apparatus is that it can accurately ascertain the resistance which the fillers of cigarettes, filter rod sections or analogous rod-shaped articles offer to axial flow of a fluid therethrough irrespective of the porosity or absence of porosity of the respective wrappers and irrespective of whether the wrappers form integral parts of the so-called NWA-filters or are draped around the fillers. Accurate determination of such resistance is especially important in connection with filter rod sections whose resistance must match or very closely approach an optimum value regardless of whether or not the wrappers of the filter rod sections merely surround or are integral with the fillers and/or whether the wrappers of filter rod sections are highly porous or not porous at all (except for the presence of holes L or similar perforations). The improved apparatus is capable of carrying out highly accurate measurements of the resistance to axial flow because it is constructed and assembled in such a way that the results of measurements are not affected by any parameters which could distort such results. The most important of these parameters is the permeability of wrappers of the filter rod sections, filter plugs and/or tobacco containing portions of smokers' products. Highly accurate results of measurements of the resistance to axial flow of a gas through the fillers can be utilized for equally accurate adjustment of the unit or units which form the holes L, e.g., of the unit or units which make holes by resorting to needles or other mechanical piercing elements or the unit or units which burn holes by resorting to laser beams, spark discharge or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. In an apparatus for ascertaining the resistance which the fillers of cigarettes, filter rod sections or analogous rod-shaped articles of the type wherein a filler is surrounded by a tubular wrapper offer to the axial flow of a gaseous fluid, the combination of a plurality of parallel receiving means for rod-shaped articles; a confining unit for each of said receiving means, said confining units including radially expansible and contractible tubular sealing elements in axial alignment with the respective receiving means; means for transporting said receiving means and said units sideways along an endless path; means for feeding articles into successive receiving means in a first portion of said path; means for transferring articles from successive receiving means into the respective sealing elements in a second portion of said path, including means for establishing a pressure differential between the axial ends of articles in said second portion of said path; means for contracting successive sealing elements into sealing engagement with the wrappers of articles therewithin in a third portion of said path; means for conveying said fluid axially through the fillers of articles in successive contracted sealing elements in a fourth portion of said path; means for expanding successive sealing elements in a fifth portion of said path; means for transferring articles from successive expanded sealing elements into the respective receiving means in a sixth portion of said path, including means for establishing a pressure differential between the axial ends of articles in said sixth portion of said path; and means for accepting articles from successive receiving means in a seventh portion of said path.

2. The combination of claim 1, wherein said fluid conveying means comprises conduit means communicating with one end of the wrapper of an article in said fourth portion of said path and means for regulating the rate of fluid flow through said conduit means.

3. The combination of claim 1, wherein said transporting means comprises discrete chambers for said sealing elements, said expanding means comprising means for reducing the pressure in said chambers around the respective sealing elements during transport of such elements along said fifth and sixth portions of said path.

4. In an apparatus for ascertaining the resistance which the fillers of cigarettes, filter rod sections or analogous rod-shaped articles of the type wherein a filler is surrounded by a tubular wrapper offer to the axial flow of a gaseous fluid, the combination of a plurality of parallel receiving means for rod-shaped articles; a confining unit for each of said receiving means, said confining units including radially expansible and contractible tubular sealing elements in axial alignment with the respective receiving means, each of said sealing elements comprising two end portions; means for transporting said receiving means and said units sideways along an endless path; means for sealingly clamping the end portions of said sealing elements to said transporting means; means for feeding articles into successive receiving means in a first portion of said path; means for transferring articles from successive receiving means into the respective sealing elements in a second portion of said path; means for contracting successive sealing elements into sealing engagement with the wrappers of articles therewithin in a third portion of said path; means for conveying said fluid axially through the fillers of articles in successive contracted sealing elements in a fourth portion of said path; means for expanding successive sealing elements in a fifth portion of said path; means for transferring articles from successive expanded sealing elements into the respective receiving means in a sixth portion of said path; and means for accepting articles from successive receiving means in a seventh portion of said path.

5. In an apparatus for ascertaining the resistance which the fillers of cigarettes, filter rod sections or analogous rod-shaped articles of the type wherein a filler is surrounded by a tubular wrapper offer to the axial flow of a gaseous fluid, the combination of a plurality of parallel receiving means for rod-shaped articles; a confining unit for each of said receiving means, said confining units including radially expansible and contractible tubular sealing elements in axial alignment with the respective receiving means; means for transporting said receiving means and said units sideways along an endless path, said transporting means comprising discrete chambers for said sealing elements and projections surrounding said chambers, said sealing elements abutting against the respective projections in the expanded condition thereof; means for feeding articles into successive receiving means in a first portion of said path; means for transferring articles from successive receiving means into the respective sealing elements in a second portion of said path; means for contracting successive sealing elements into sealing engagement with the wrappers of articles therewithin in a third portion of said path; means for conveying said fluid axially through the fillers of articles in successive contracted sealing elements in a fourth portion of said path; means for expanding successive sealing elements in a fifth portion of said path; means for transferring articles from successive expanded sealing elements into the respective receiving means in a sixth portion of said path, said expanding means comprising means for reducing the pressure in said chambers around the respective sealing elements during transport of such elements along said fifth and sixth portions of said path; and means for accepting articles from successive receiving means in a seventh portion of said path.

6. The combination of claim 5, wherein said projections define a plurality of recesses in communication with the respective chambers, said pressure reducing means including a suction generating device and means for connecting said device with all of the recesses during transport of the respective chambers along said fifth and sixth portions of said path.

7. In an apparatus for ascertaining the resistance which the fillers of cigarettes, filter rod sections or analogous rod-shaped articles of the type wherein a filler is surrounded by a tubular wrapper offer to the axial flow of a gaseous fluid, the combination of a plurality of parallel receiving means for rod-shaped articles; a stationary valve member; a confining unit for each of said receiving means, said confining units including radially expansible and contractible tubular sealing elements in axial alignment with the respective receiving means, said sealing elements having first and second open ends respectively adjacent to and remote from the corresponding receiving means; means for transporting said receiving means and said units sideways along an endless path, said transporting means having a plurality of bores, one for each of said units and each communicating with the second end of the respective sealing element, said bores being adjacent to said valve member; means for feeding articles into successive receiving means in a first portion of said path; means for transferring articles from successive receiving means into the respective sealing elements in a second portion of said path; means for contracting successive sealing elements into sealing engagement with the wrappers of articles therewithin in a third portion of said path; means for conveying said fluid axially through the fillers of articles in successive contracted sealing elements in a fourth portion of said path, said conveying means comprising a testing unit and conduit means connecting said bores with said testing unit by way of said valve member during transport of the respective confining units along said fourth portion of said path; means for expanding successive sealing elements in a fifth portion of said path; means for transferring articles from successive expanded sealing elements into the respective receiving means in a sixth portion of said path, including a source of pressurized fluid and means for connecting said source with said bores by way of said valve member during transport of the respective receiving means along said sixth portion of said path; and means for accepting articles from successive receiving means in a seventh portion of said path.

8. The combination of claim 7, wherein said means for transferring articles from successive receiving means comprises a suction generating device and means for connecting said device with said bores by way of said valve member during transport of the respective receiving means along said second portion of said path.

9. In an apparatus for ascertaining the resistance which the fillers of cigarettes, filter rod sections or analogous rod-shaped articles of the type wherein a filler is surrounded by a tubular wrapper offer to the axial flow of a gaseous fluid, the combination of a plurality of parallel receiving means for rod-shaped articles, said receiving means including flutes each having a depth exceeding the diameter of a rod-shaped article; a confining unit for each of said receiving means, said confining units including radially expansible and contractible tubular sealing elements in axial alignment with the respective receiving means; means for transporting said receiving means and said units sideways along an endless path; means for feeding articles into successive receiving means in a first portion of said path; means for transferring articles from successive receiving means into the respective sealing elements in a second portion of said path; a shroud overlying said flutes during transport of such flutes along said second portion of said path; means for contracting successive sealing elements into sealing engagement with the wrappers of articles therewithin in a third portion of said path; means for conveying said fluid axially through the fillers of articles in successive contracted sealing elements in a fourth portion of said path; means for expanding successive sealing elements in a fifth portion of said path; means for transferring articles from successive expanded sealing elements into the respective receiving means in a sixth portion of said path; and means for accepting articles from successive receiving means in a seventh portion of said path.

10. In an apparatus for ascertaining the resistance which the fillers of cigarettes, filter rod sections or analogous rod-shaped articles of the type wherein a filler is surrounded by a tubular wrapper offer to the axial flow of a gaseous fluid, the combination of a plurality of parallel receiving means for rod-shaped articles, said receiving means including flutes each having a depth exceeding the diameter of a rod-shaped article; a confining unit for each of said receiving means, said confining units including radially expansible and contractible tubular sealing elements in axial alignment with the respective receiving means; means for transporting said receiving means and said units sideways along an endless path; means for feeding articles into successive receiving means in a first portion of said path; means for transferring articles from successive receiving means into the respective sealing elements in a second portion of said path; means for contracting successive sealing elements into sealing engagement with the wrappers of articles therewithin in a third portion of said path; means for conveying said fluid axially through the fillers of articles in successive contracted sealing elements in a fourth portion of said path; means for expanding successive sealing elements in a fifth portion of said path; means for transferring articles from successive expanded sealing elements into the respective receiving means in a sixth portion of said path; a shroud overlying said flutes during transport of such flutes along said sixth portion of said path; and means for accepting articles from successive receiving means in a seventh portion of said path.

11. In an apparatus for ascertaining the resistance which the fillers of cigarettes, filter rod sections or analogous rod-shaped articles of the type wherein a filler is surrounded by a tubular wrapper offer to the axial flow of a gaseous fluid, the combination of a plurality of parallel receiving means for rod-shaped articles; a confining unit for each of said receiving means, said confining units including radially expansible and contractible tubular sealing elements in axial alignment with the respective receiving means, said receiving means including flutes having first and second open ends respectively adjacent to and remote from the corresponding sealing elements; means for transporting said receiving means and said units sideways along an endless path; means for feeding articles into successive receiving means in a first portion of said path; means for transporting articles from successive receiving means into the respective sealing elements in a second portion of said path, said transferring means including means for admitting a pressurized fluid into the second ends of said flutes during transport of such flutes along said second portion of said path; means for contracting successive sealing elements into sealing engagement with the wrappers of articles therewithin in a third portion of said path; means for conveying said fluid axially through the fillers of articles in successive contracted sealing elements in a fourth portion of said path; means for expanding successive sealing elements in a fifth portion of said path; means for transferring articles from successive expanded sealing elements into the respective receiving means in a sixth portion of said path; and means for accepting articles from successive receiving means in a seventh portion of said path.

12. In an apparatus for ascertaining the resistance which the fillers of cigarettes, filter rod sections or analogous rod-shaped articles of the type wherein a filler is surrounded by a tubular wrapper offer to the axial flow of a gaseous fluid, the combination of a plurality of parallel receiving means for rod-shaped articles; a confining unit for each of said receiving means, said confining units including radially expansible and contractible tubular sealing elements in axial alignment with the respective receiving means, said receiving means including flutes having first and second open ends respectively adjacent to and remote from the corresponding sealing elements; means for transporting said receiving means and said units sideways along an endless path; means for feeding articles into successive receiving means in a first portion of said path; means for transferring articles from successive receiving means into the respective sealing elements in a second portion of said path; means for contracting successive sealing elements into sealing engagement with the wrappers of articles therewithin in a third portion of said path; means for conveying said fluid axially through the fillers of articles in successive contracted sealing elements in a fourth portion of said path; means for expanding successive sealing elements in a fifth portion of said path; means for transferring articles from successive expanded sealing elements into the respective receiving means in a sixth portion of said path; including means for drawing air from the second ends of said flutes during transport of such flutes along said sixth portion of said path; and means for accepting articles from successive receiving means in a seventh portion of said path.

13. In an apparatus for ascertaining the resistance which the fillers of cigarettes, filter rod sections or analogous rod-shaped articles of the type wherein a filler is surrounded by a tubular wrapper offer to the axial flow of a gaseous fluid, the combination of a plurality of parallel receiving means for rod-shaped articles; a confining unit for each of said receiving means, said confining units including radially expansible and contractible tubular sealing elements in axial alignment with the respective receiving means, the length of said sealing elements being less than the length of rod-shaped articles and each of said sealing elements comprising a first and a second open end respectively adjacent to and remote from the corresponding receiving means; means for transporting said receiving means and said units sideways along an endless path, said transporting means having a plurality of chambers, one for each of said sealing elements and each communicating with the second end of the respective sealing element; means for feeding articles into successive receiving means in a first portion of said path; means for transferring articles from successive receiving means into the respective sealing elements in a second portion of said path, a portion of each rod-shaped article which is transferred into the respective sealing element extending into the corresponding chamber; means for contracting successive sealing elements into sealing engagement with the wrappers of articles therewithin a third portion of said path; means for conveying said fluid axially through the fillers of articles in successive contracted sealing elements in a fourth portion of said path; means for expanding successive sealing elements in a fifth portion of said path; means for transferring articles from successive expanded sealing elements into the respective receiving means in a sixth portion of said path; and means for accepting articles from successive receiving means in a seventh portion of said path; said transporting means further having means for connecting said chambers with the atmosphere during transport of such chambers along a further portion of said path in which said sealing elements are contracted.

14. The combination of claim 13, wherein said portions of rod-shaped articles are filter mouthpieces each having a predetermined length and the length of said chambers, as considered in the axial direction of the respective sealing elements, at most equals said predetermined length.

15. The combination of claim 14, wherein each filter mouthpiece has an exposed end face and further comprising means for sealing the end faces of filter mouthpieces from the respective chambers, each of said sealing means having an aperture adjacent to the end face of the filter mouthpiece in the respective chamber.

16. The combination of claim 15, wherein each of said sealing means comprises a deformable membrane.

17. The combination of claim 13, further comprising means for conveying said fluid axially through the fillers of articles in successive contracted sealing elements in said further portion of said path so that the chambers which are transported along said fourth and further portions of said path are respectively sealed from and communicate with the atmosphere.

18. The combination of claim 17, further comprising means for evaluating the characteristics of fluids which are conveyed through the fillers of articles in said fourth and further portions of said path.

19. The combination of claim 18, wherein said evaluating means comprises first and second signal generators respectively arranged to transmit first and second signals denoting the characteristics of fluids which have passed through the fillers of articles in said fourth and further portions of said path, and means for comparing the first and second signals which are generated by fluid flowing through the filler of one and the same article.

20. The combination of claim 19, further comprising time-delay means interposed between one of said signal generating means and said comparing means.

* * * * *